US005850863A

United States Patent [19]

Huang

[11] Patent Number: 5,850,863

[45] Date of Patent: Dec. 22, 1998

[54] OPERATING DEVICE FOR A VENETIAN BLIND TO CONTROL RAISING AND LOWERING OF THE SLATS AND TO ADJUST TILTING ANGLE OF THE SLATS

[76] Inventor: Tai-Long Huang, No. 382, Sec. 1, Yuan-Lu Rd., Fu-Hsing, Hsiang, Chang-Hua Hsien, Taiwan

[21] Appl. No.: 966,516

[22] Filed: Nov. 10, 1997

Related U.S. Application Data

[63] Continuation-in-part of Ser. No. 844,406, Apr. 18, 1997, Pat. No. 5,749,405.

[51] Int. Cl.[6] ..... E06B 9/30

[52] U.S. Cl. ..... 160/168.1 R; 160/176.1 R; 160/178.2 R

[58] Field of Search ..... 160/168.1 R, 173 R, 160/176.1 R, 177 R, 178.1 R, 178.2 R, 107, 172 R, 171 R, 170 R

[56] References Cited

U.S. PATENT DOCUMENTS

| | | | |
|---|---|---|---|
| 3,633,646 | 1/1972 | Zilver | 160/178.2 R X |
| 5,465,775 | 11/1995 | Biba et al. | 160/168.1 R |
| 5,472,036 | 12/1995 | Judkins | 160/178.2 R |
| 5,501,262 | 3/1996 | Inaba et al. | 160/178.2 R |
| 5,553,649 | 9/1996 | Chisaka et al. | 160/178.2 R X |
| 5,623,982 | 4/1997 | Okazaki | 160/178.2 R |
| 5,709,258 | 1/1998 | Coccoluto | 160/178.2 R X |

*Primary Examiner*—David M. Purol
*Attorney, Agent, or Firm*—Ladas & Parry

[57] ABSTRACT

An operating device for a Venetian blind includes a hollow base which is adapted to be disposed in a top housing of the Venetian blind, a locking seat disposed in the hollow base, and a biasing member. The hollow base includes a pair of side plates which form a receiving space therebetween, and a limiting rod which extends transversely between the side plates and which is disposed at a peripheral portion of the receiving space. The hollow base is adapted to permit extension of pull ropes of the Venetian blind into the receiving space. The locking seat is mounted pivotally to the side plates and is disposed in the receiving space on one side of the limiting rod such that the pull ropes are extendible between the locking seat and the limiting rod. The biasing member is mounted on the hollow base and biases the locking seat to pivot toward the limiting rod so that the locking seat is adapted to clamp releasably the pull ropes against the limiting rod.

7 Claims, 5 Drawing Sheets

OPERATING DEVICE FOR A VENETIAN BLIND TO CONTROL RAISING AND LOWERING OF THE SLATS AND TO ADJUST TILTING ANGLE OF THE SLATS

CROSS REFERENCE TO RELATED APPLICATION

This application is a continuation-in-part (CIP) of U.S. patent application Ser. No. 08/844,406, filed on Apr. 18, 1997 now U.S. Pat. No. 5,749,405.

BACKGROUND OF THE INVENTION

1. Field of the Invention

The present invention relates to an operating device for a Venetian blind to control raising and lowering of the slats and to adjust tilting angle of the slats, more particularly to an operating device having a locking seat adapted to be disposed in the top housing of the Venetian blind for locking pull ropes of the latter.

2. Description of the Related Art

A conventional Venetian blind includes an elongated housing, a horizontally disposed shaft journalled in the housing, a plurality of slats suspended one above another from the housing, a bottom rail disposed below the slats, an operating rod for controlling tilting of the slats, two pairs of tilting cords, and a pair of pull ropes. Each of the tilting cords is disposed at a longitudinal side of each of the slats, and has a top end secured to the shaft and a bottom end secured to the bottom rail so that rotation of the shaft can cause the tilting cords to move up and down in order to tilt the slats. The operating rod is operable to cause rotation of the shaft. Each of the pull ropes has a first end passing through a respective end portion of the slats and secured to the bottom rail, and a second end extending out of the housing.

The aforementioned Venetian blind achieves the purposes of raising and lowering the slats and adjusting the tilting angle of the slats to control passage of light through the Venetian blind. However, the operating rod for controlling tilting of the slats is separate from end portions of the pull ropes that extend out of the top housing. The conventional Venetian blind is thus inconvenient to operate and has a disorderly appearance.

Referring to FIG. 1, a conventional operating device has been developed to solve the aforementioned problem. The conventional operating device includes an operating rod which is operable to control raising and lowering of the slats and to adjust tilting angle of the slats and which has an elongated sleeve 5 to permit passage of the pull ropes 6 therethrough and to conceal portions of the pull ropes 6 that extend out of the top housing of the Venetian blind.

Although the aforementioned operating device offers the advantage of combining the functions of controlling raising and lowering of the slats and adjusting tilting angle of the slats in a single structure, the relatively long pull ropes 6 have portions that extend out of the elongated sleeve 5 and that remain exposed so as to be accessible to children. User safety cannot be ensured.

U.S. patent application Ser. No. 08/844,406 by the Applicant discloses an operating device which solves the problem of user safety. The operating device includes a rotary tilt control unit, a positioning tube, a retaining member, a biasing spring, an elongated sleeve and an insert pin. The rotary tilt control unit has first and second ends. The first end is adapted to be coupled to the shaft of the Venetian blind such that axial rotation of the tilt control unit results in corresponding axial rotation of the shaft to adjust tilting angles of the slats. The positioning tube is connected to the second end of the tilt control unit, and has a top wall formed with a top opening and a surrounding wall extending downwardly from a periphery of the top wall. The top wall and the surrounding wall cooperatively confine a receiving space. The top opening is adapted to permit extension of the pull ropes through the positioning tube. The surrounding wall has an axially extending slot unit formed therethrough. The retaining member is axially movable in the receiving space of the positioning tube, and has a tapered upper end portion which is extendible through the top opening of the positioning tube, a hollow lower end portion and a radial pin hole aligned with the slot unit. The retaining member is provided with a pair of axially extending guiding grooves for receiving the pull ropes. Each of the guiding grooves has a depth not greater than diameter of each of the pull ropes. The biasing spring is disposed in the positioning tube under the retaining member for biasing the retaining member upwardly so that the pull ropes can be clamped between the tapered upper end portion of the retaining member and the top wall of the positioning tube. The elongated sleeve is disposed around the positioning tube and is formed with a radial hole aligned with the pin hole of the retaining member. The elongated sleeve has a length sufficient to conceal major portions of the pull ropes that extend out of the positioning tube. The elongated sleeve further has an outer surface with at least one hook projection adapted for hooking end portions of the pull ropes that extend out of the elongated sleeve thereon. The insert pin extends through the radial hole of the elongated sleeve, the slot unit of the positioning tube and into the pin hole of the retaining member. The elongated sleeve is movable downwardly relative to the positioning tube so that the insert pin and the retaining member are moved downwardly against biasing action of the biasing spring together with the elongated sleeve, thereby retracting the tapered upper end portion o the retaining member into the positioning tube for releasing the pull ropes.

SUMMARY OF THE INVENTION

The object of the present invention is to provide an operating device for a Venetian blind, wherein a locking seat of the device is adapted to be disposed in the top housing of the Venetian blind for locking pull ropes of the latter.

Accordingly, the operating device of the present invention is used for a Venetian blind which includes an elongated top housing, a horizontally disposed shaft journalled in the top housing, a plurality of horizontal slats suspended one above another from the top housing, each of the slats having two opposite as longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on the opposite longitudinal sides of the slats and having upper ends secured to the shaft and lower ends mounted on the bottom rail, and a plurality of suspending strings disposed below each of the slats to interconnect the tilting cords. The operating device includes a hollow base, a locking seat and a biasing member. The hollow base is adapted to be disposed in the top housing and includes a pair of side plates which form a receiving space therebetween, and a limiting rod extending transversely between the side plates and disposed at a peripheral portion of the receiving space. The hollow base is adapted to permit extension of the second ends of the pull ropes into the receiving space. The locking seat is mounted pivotally to the side plates and is disposed in the receiving space on one side of the limiting rod such that the pull ropes are extendible between the locking seat and the limiting rod. The biasing member is mounted on the hollow base for biasing the locking seat to pivot toward the limiting rod so that the locking seat is adapted to clamp releasably the pull ropes against the limiting rod.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
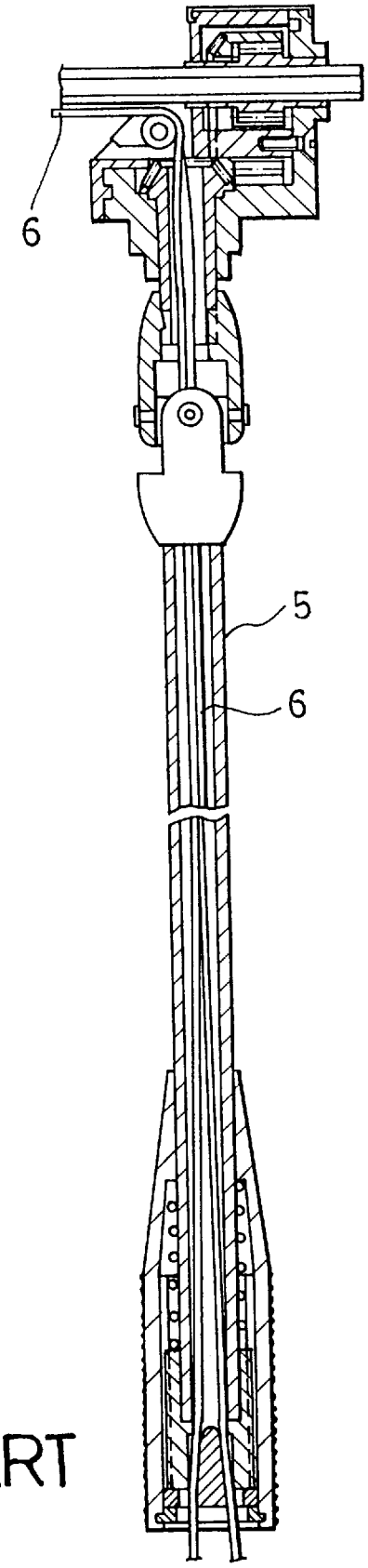
FIG.1 PRIOR ART
FIG. 1 is a vertical sectional view illustrating a conventional operating device for controlling raising and lowering of the slats and for adjusting tilting angle of the slats.
Figure 2:
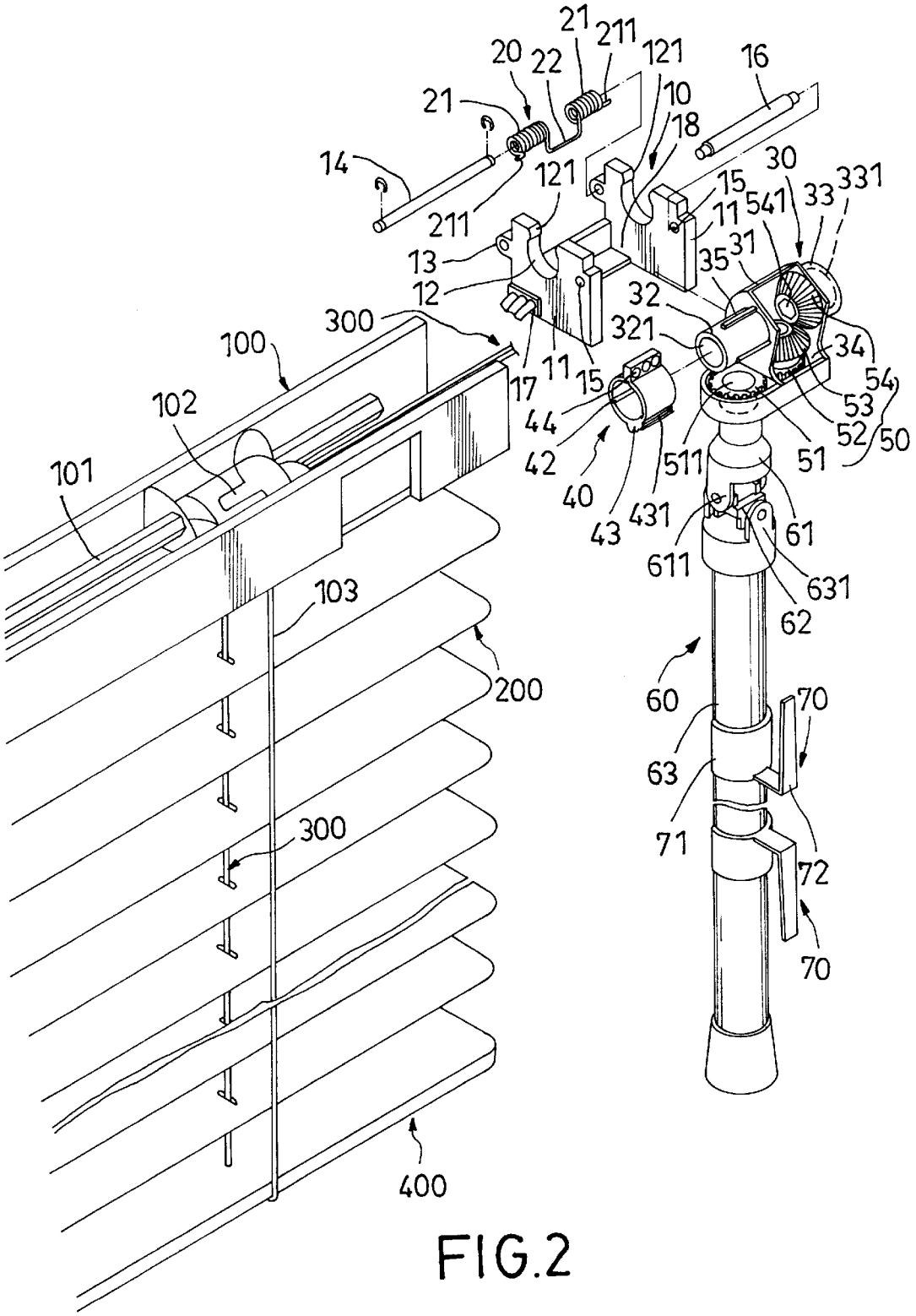
FIG. 2 is an exploded perspective view illustrating an operating device according to a preferred embodiment of the present invention and a Venetian blind to which the operating device is applied.

Referring to FIG. 2, the operating device of the present invention is adapted for use with a conventional Venetian blind which includes an elongated top housing 100, a horizontally disposed shaft 101 journalled in the top housing 100 and having a hexagonal cross-section, a plurality of tilting cord seats 102 (only one is shown in FIG. 2) secured on the shaft 101, a plurality of horizontal slats 200 suspended one above another from the top housing 100, a bottom rail 400 disposed below the slats 200, a plurality of pull ropes 300, each of which has a first end that passes through the housing 100 and through the slats 200 and that is mounted to the bottom rail 400, and a second end that extends out of the housing 100, a plurality of pairs of tilting cords 103 disposed on opposite longitudinal sides of the slats 200 and having upper ends secured to the tilting cord seats 102 on the shaft 101 and lower ends mounted on the bottom rail 400, and a plurality of suspending strings disposed below each of the slats 200 for interconnecting the tilting cords 103.

The operating device according to the preferred embodiment of the present invention includes a hollow base 10, a locking seat 30, a biasing member 20, a rotary tilt control unit 50 and two retaining rings 70.

The hollow base 10 is adapted to be disposed in the top housing 100 and includes a parallel pair of side plates 11 which form a receiving space 18 therebetween. Each of the side plates 11 is formed with a pivot hole 12 adapted to be aligned with the shaft 101 of the Venetian blind, a limiting protrusion 121 at a periphery of the pivot hole 12, and a lobe 13 extending from a rear edge portion thereof. The lobes 13 are formed with holes for receiving a retaining rod 14 so that the retaining rod 14 extends transversely between the side plates 11. The side plates 11 are further formed with aligned holes 15 at front edge portions thereof for receiving a limiting rod 16 so that the limiting rod 16 extends transversely between the side plates 11. The limiting rods 16 and the retaining rod 14 are thus disposed at opposite peripheral portions of the receiving space 18 and on opposite sides of the pivot holes 12. One of the side plates 11 that is disposed adjacent to an outermost one of the tilting cord seats 102 of the Venetian blind is formed with three holes 17 which are adapted to permit passage of the second ends of three pull ropes 300 therethrough and to permit extension of the second ends of the pull ropes 300 into the receiving space 18.

The biasing member 20 includes a pair of torsion springs 21 which are sleeved on the retaining rod 14 and which have first ends 211 respectively abutting against the side plates 11 of the hollow base 10 and second ends connected to one another to form a biasing portion 22.

The locking seat 30 is disposed in the receiving space 18 and has a casing 31, and opposite first and second tubular extensions 32, 33 extending from the casing 31 and extending rotatably into the pivot holes 12 so as to mount the locking seat 30 pivotally to the side plates 11 of the hollow base 10. The limiting protrusions 121 formed on the side plates 11 act to retain the tubular extensions 32, 33 in the pivot holes 12. The locking seat 30 is thus disposed between the biasing member 20 and the limiting rod 16. The first and second tubular extensions 32, 33 are coaxial to one another and have axial holes 321, 331 aligned with the pivot holes 12 and with a space 34 formed in the casing 31 so that the shaft 101 of the Venetian blind is extendible through first tubular extension 32 and into the space 34. The first tubular extension 32 has an outer surface formed with three axially extending ribs 35 (only two are shown in FIG. 2). The locking seat 30 includes a retaining sleeve 40 which has an inner surface formed with three axially extending grooves 42 for engaging the ribs 35 on the first tubular extension 32 so as to be sleeved securely on the first tubular extension 32. The retaining sleeve 40 has an outer surface formed with a retaining protrusion 43 which is provided with teeth 431 thereon. The retaining sleeve 40 is further formed with three guiding holes 44 adapted for guiding the second ends of the pull ropes 300 that extend into the receiving space 18 so that the pull ropes 300 pass through the guiding holes 44 and are extendible between the retaining protrusion 43 of the retaining sleeve 40 and the limiting rod 16. The biasing portion 22 of the biasing member 20 abuts against the casing 31 of the locking seat 30 to bias the locking seat 30 to pivot towards the limiting rod 16 so that retaining protrusion 43 is adapted to clamp releasably the pull ropes 300 against the limiting rod 16 to lock the pull ropes 300. The teeth 431 provides an enhanced friction between the retaining protrusion 43 and the pull ropes 300.

The tilt control unit includes a rotary gear assembly 50 mounted within the locking seat 30. The rotary gear assembly 50 includes a first gear 51 having a first vertical axis, a second gear 52 engaging the first gear 51 and having a second vertical axis parallel to the first vertical axis, a horizontal bevel gear 53 coupled fixedly to an upper end of the second gear 52 and coaxial with the second gear 52, and a vertical bevel gear 54 engaging the horizontal bevel gear 53. The first gear 51 has an axial hole 511 which is located immediately below the retaining sleeve 40 so that the pull ropes 300 that extend between the retaining protrusion 43 and the limiting rod 16 are extendible into the axial hole 511. The vertical bevel gear 54 is mounted rotatably in the axial hole 331 of second tubular extension 33 of the locking seat 30, and has a hexagonal axial hole 541 which is adapted to receive fittingly the shaft 101 of the Venetian blind for coupling with the shaft 101.

The tilt control unit further includes an operating rod 60 having a tubular connector 61, an annular connector 62 and an elongated sleeve 63. The tubular connector 61 has an upper end connected securely to the first gear 51 and a lower end adapted to extend out of the top housing 10 and formed with an opposite pair of first pivot lobes 611. The elongated sleeve 63 has an upper end formed with an opposite pair of second pivot lobes 631. The annular connector 62 is disposed between the lower end of the tubular connector 61 and the upper end of the elongated sleeve 63. The annular connector 62 is connected pivotally to the first pivot lobes 611 about a first axis and to the second pivot lobes 612 about a second axis perpendicular to the first axis. Therefore, a universal pivot joint is formed between the elongated sleeve 63 and the tubular connector 61. The tubular connector 61, the annular connector 62 and the elongated sleeve 63 are communicated with the axial hole 511 of the first gear 51 to be adapted to permit passage of the second ends of the pull ropes 300 therethrough. The elongated sleeve 63 has a length sufficient to conceal major portions of the pull ropes 300 that extend through the axial hole 511 of the first gear 51.

Each of the retaining rings 70 includes a ring portion 71 sleeved securely on an outer surface of the elongated sleeve 63, and an L-shaped hook projection 72 extending integrally from the ring portion 71. The retaining rings 70 in the present embodiment include an upper one with the hook projection 72 extending upward and a lower one with the hook projection 72 extending downward. The end portions of the pull ropes 300 that extend out of the elongated sleeve 63 may be wound around both of the hook projections 72 and hooked on one of the hook projections 72.

Figure 3:
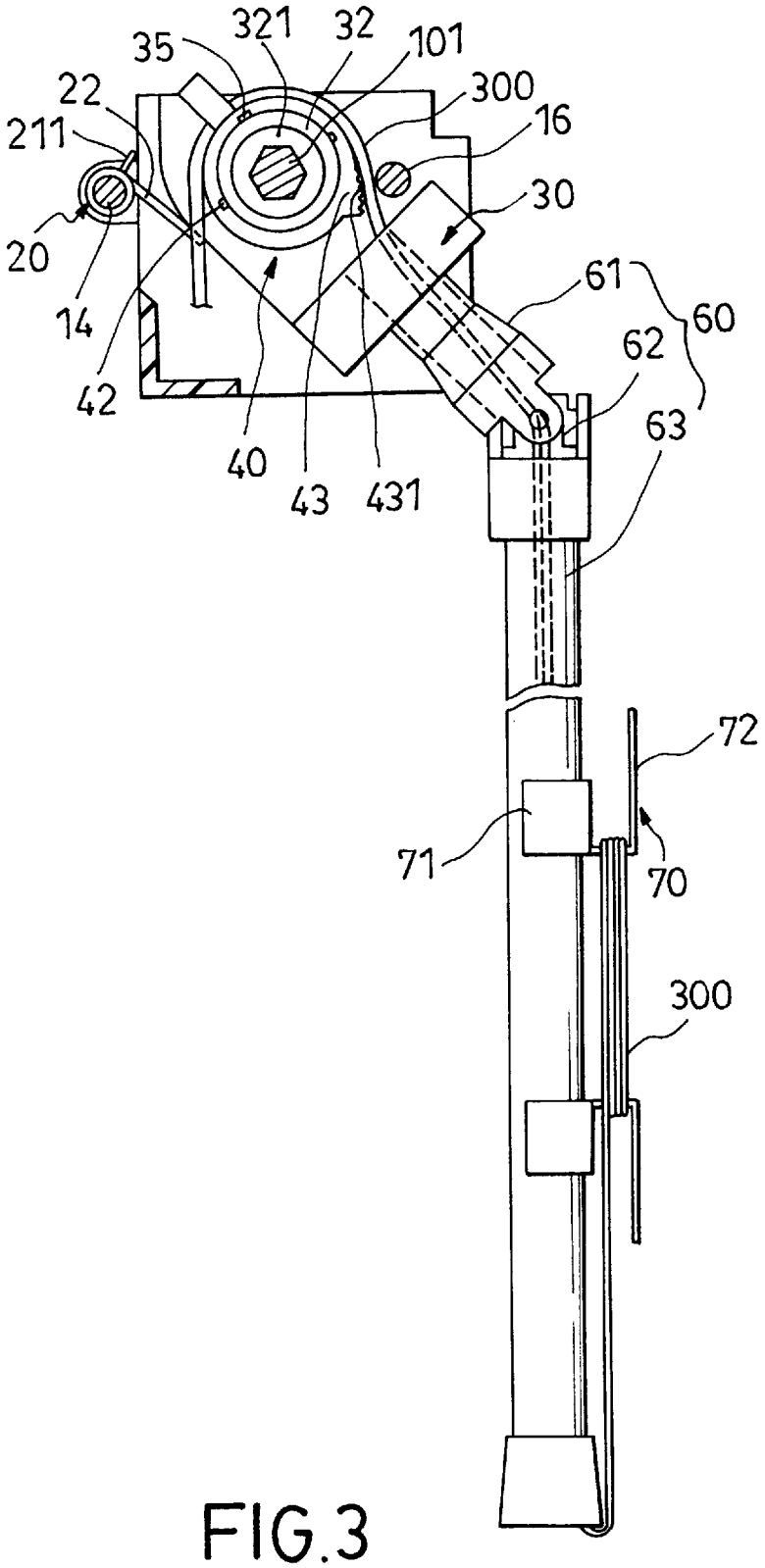
FIG. 3 is a partly sectional view of the operating device of the preferred embodiment.
Figure 4:
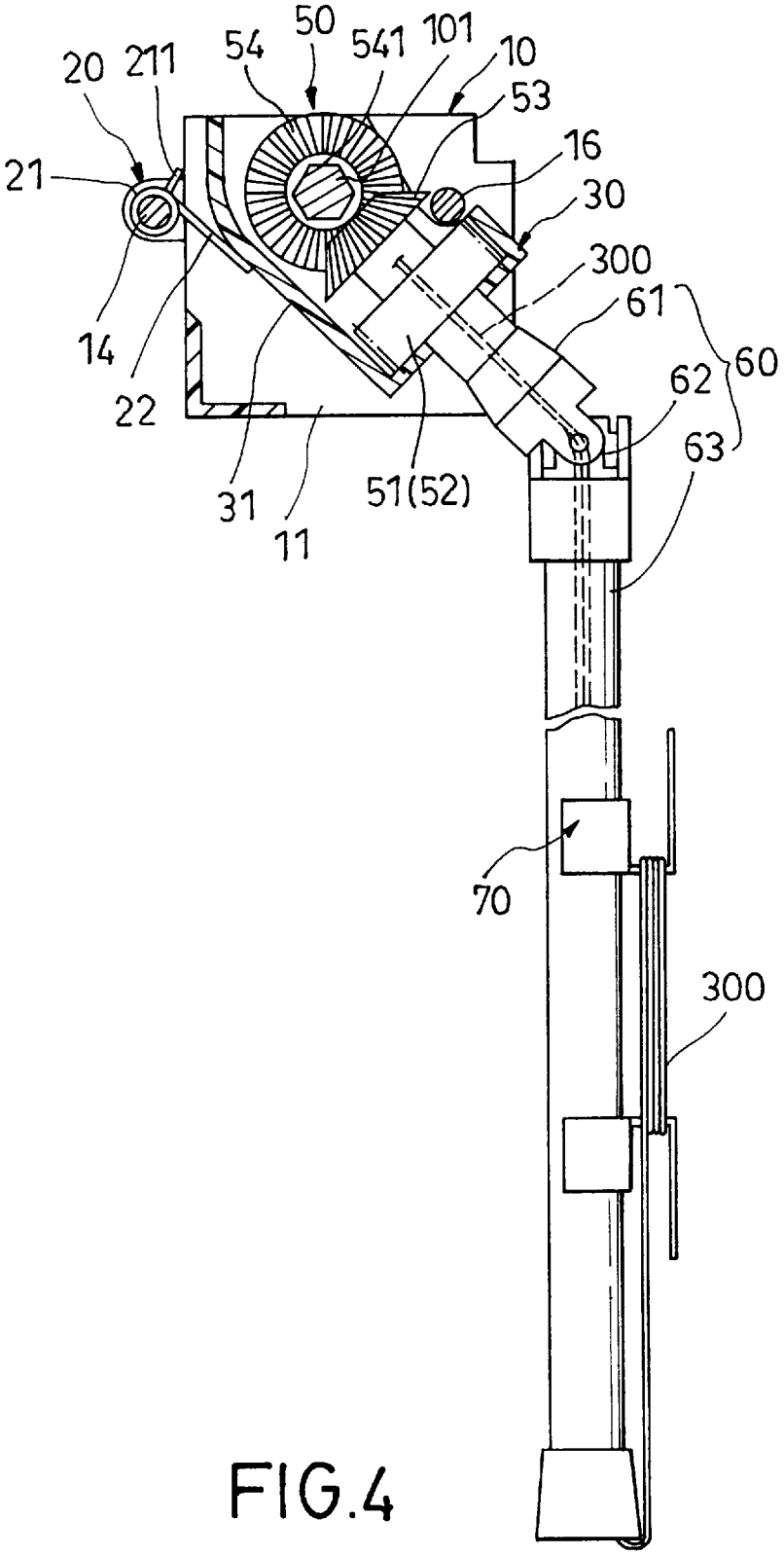
FIG. 4 is another partly sectional view of the operating device of the preferred embodiment.

Referring to FIGS. 3 and 4, after the operating device has been installed on a Venetian blind, the shaft 101 extends into the hollow base 10 and the locking seat 30 to be received fittingly in the hexagonal hole 541 of the vertical bevel gear 54 so as to be coupled to the rotary gear assembly 50 in order for the shaft 101 to be driven by the rotary gear assembly 50 to result in axial rotation thereof. The biasing portion 22 of the biasing member 20 abuts against the casing 31 of the locking seat 30 and normally biases the retaining protrusion 43 of the retaining sleeve 40 to pivot toward the limiting rod 16 together with the locking seat 30. The pull ropes 300 are thus tightly clamped between the retaining protrusion 43 and the limiting rod 16, thereby positioning the slats 200 of the Venetian blind. The end portions of the pull ropes 300 extend out of the elongated sleeve 63 for winding around the hook projections 72 and are to be hooked on one of the hook projections 72 to prevent access of children thereto.

When the slats 200 are to be raised, the end portions of the pull ropes 300 are released from the hook projections 72 and are pulled downwardly so that the retaining protrusion 43 is pushed by the pull ropes 300 to move away from the limiting rod 16 against biasing action of the biasing member 20, thereby releasing the pull ropes 300. After the slats 200 are adjusted to a desired position, the pulling force applied to the end portions of the pull ropes 300 is released so that the retaining protrusion 43 returns to its biased position to clamp the pull ropes 300 against the limiting rod 16 to position the slats 200.

Figure 5:
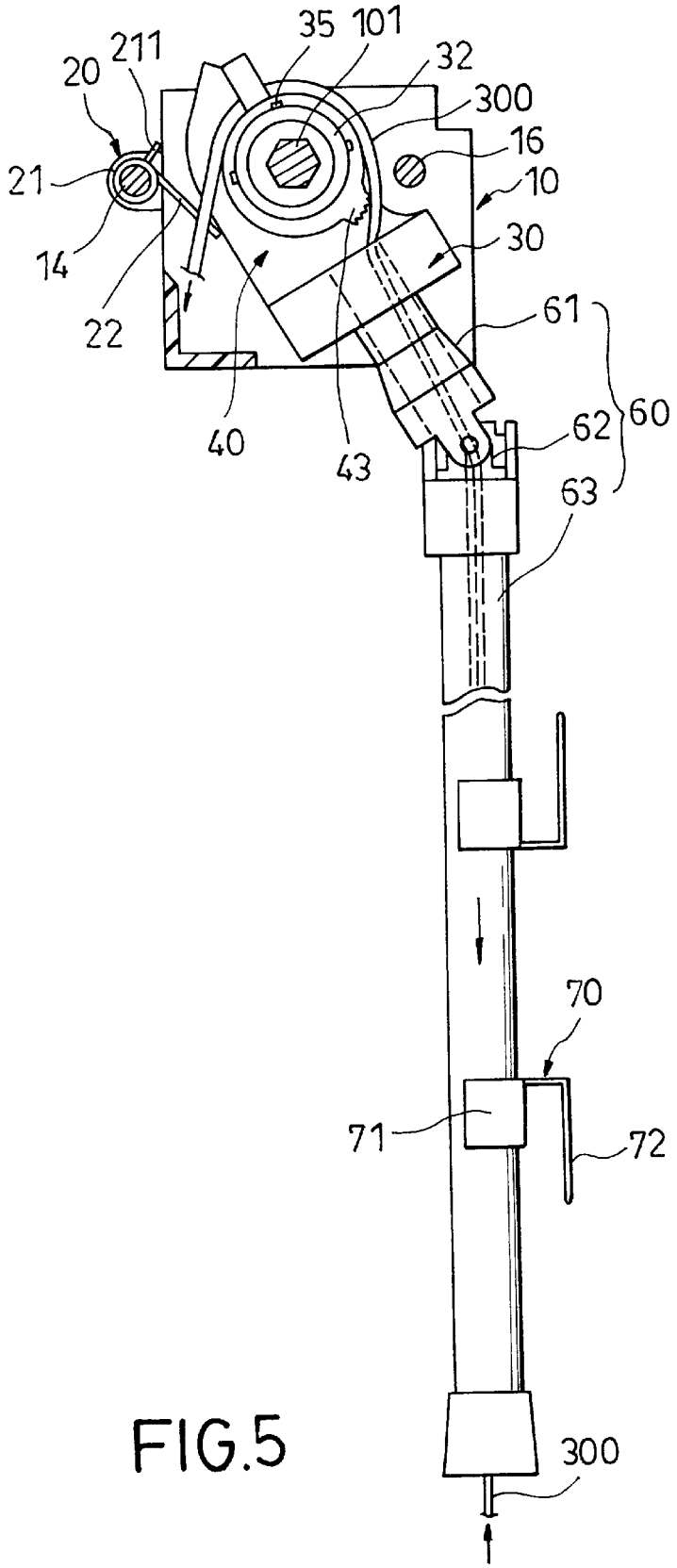
FIG. 5 illustrates how the operating device of the preferred embodiment is operated to lower the slats of the Venetian blind.

Referring to FIG. 5, when the slats 200 are to be lowered, a downward force is applied to the elongated sleeve 63. Since the elongated sleeve 63 is connected to the tubular connector 61 by virtue of a universal joint, and since the tubular connector 61, in turn, is connected securely to the first gear 51 which is mounted in the locking seat 30, the tubular connector 61 and the locking seat 30 are moved by the elongated sleeve 63 to pivot about the axis of the pivot holes 12 in a clockwise direction against the biasing action of the biasing member 30. The retaining protrusion 43 of the locking seat 30 is thus moved away from the limiting rod 16 to release the pull ropes 300. At this time, the slats 200 are lowered by virtue of the weight of the bottom rail 400, and the end portions of the pull ropes 300 are pulled to move in a direction opposite to movement of the elongated sleeve 63. When the downward force applied on the elongated sleeve 63 is released, the locking seat 30 returns to its biased position to clamp the pull ropes 300 between the retaining protrusion 43 and the limiting rod 16.

Referring against to FIG. 2, to adjust the tilting angle of the slats 200, the elongated sleeve 63 is rotated axially. Since the elongated sleeve 63 is connected to the tubular connector 61 by virtue of the universal joint, the tubular connector 61 is rotated axially together with the elongated sleeve 63 to cause axial rotation of the first and second gears 51, 52 and the horizontal and vertical bevel gears 53, 54, thereby causing corresponding axial rotation of the shaft 101 so as to tilt the slats 200.

The specific structure of the tilt control unit should not be limited to the preferred embodiment. Other forms of tilt control units may be used as long as rotation of the tilt control unit results in corresponding axial rotation of the shaft. A conventional tilt control unit, which includes a worm and a worm gear, may also be modified for use in the present invention.

It has been shown that the operating device of the present invention has combined functions of controlling raising and lowering of the slats 200 and adjusting tilting angle of the slats 200 and that the operating device of the present invention is capable of concealing major portions of the pull ropes 300 so that the Venetian blind has an orderly appearance. Moreover, the exposed end portions of the pull ropes 300 that extend out of the elongated sleeve 63 can be hooked on one of the hook projections 72 to prevent access by children thereto.

With this invention thus explained, it is apparent that numerous modifications and variations can be made without departing from the scope and spirit of this invention. It is therefore intended that this invention be limited only as indicated in the appended claims.

I claim:

1. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on the opposite longitudinal sides of the slats and having upper ends secured to the shaft and lower ends mounted on the bottom rail, and plurality of suspending strings disposed below each of the slats and interconnecting the tilting cords, said operating device comprising:

a hollow base adapted to be disposed in the top housing, said hollow base including a pair of side plates which form a receiving space therebetween, and a limiting rod extending transversely between said side plates and disposed at a peripheral portion of said receiving space, said hollow base being adapted to permit extension of the second ends of the pull ropes and the shaft into said receiving space;

a locking seat mounted pivotally to said side plates and disposed in said receiving space on one side of said limiting rod such that the pull ropes are extendible between said locking seat and said limiting rod, wherein said hollow base and said locking seat are adapted to permit extension of the shaft of the Venetian blind thereinto;

a biasing member mounted on said hollow base for biasing said locking seat to pivot toward said limiting rod so that said locking seat is adapted to clamp releasably the pull ropes against said limiting rod; and a rotary tilt control unit mounted within said locking seat, said tilt control unit including a first gear having a first vertical axis, a second gear engaging said first gear and having a second vertical axis parallel to said first vertical axis, a horizontal bevel gear coupled to said second gear and coaxial with said second gear, a vertical bevel gear adapted to be coupled to the shaft of the Venetian blind and engaging said horizontal bevel gear, and an operating rod connected to said first gear, said operating rod being operable to cause axial rotation of said gears so as to result in corresponding axial rotation of the shaft to adjusting tilting angles of the slats, said operating rod being further operable to move said locking seat away from said limiting rod against biasing action of said biasing member so as to release the pull ropes.

2. The operating device according to claim 1, wherein said first gear of said rotary tilt control unit has an axial hole, said operating rod including an elongated sleeve connected to said first gear and communicated with said axial hole, said axial hole and said elongated sleeve being adapted to permit passage of the second ends of the pull ropes therethrough, said elongated sleeve having a length sufficient to conceal major portions of the pull ropes that extend through said first gear, said elongated sleeve further having an outer surface with at least one hook projection adapted for hooking end portions of the pull ropes that extend out of said elongated sleeve thereon.

3. The operating device according to claim 2, wherein said operating rod further includes a tubular connector having an upper end connected securely to said first gear and a lower end formed with an opposite pair of first pivot lobes, and an annular connector connected pivotally to said first pivot lobes about a first axis, said elongated sleeve having an upper end formed with an opposite pair of second pivot lobes which are connected pivotally to said annular connector about a second axis perpendicular to said first axis.

4. The operating device according to claim 2, further comprising at least one retaining ring which is sleeved on said elongated sleeve and which has said hook projection formed thereon.

5. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on the opposite longitudinal sides of the slats and having upper ends secured to the shaft and lower ends mounted on the bottom rail, and plurality of suspending strings disposed below each of the slats and interconnecting the tilting cords, said operating device comprising:

a hollow base adapted to be disposed in the top housing, said hollow base including a pair of side plates which form a receiving space therebetween, and a limiting rod extending transversely between said side plates and disposed at a peripheral portion of said receiving space, said hollow base being adapted to permit a locking seat mounted pivotally to said side plates and disposed in said receiving space on one side of said limiting rod such that the pull ropes are extendible between said locking seat and said limiting rod; and a biasing member mounted on said hollow base for biasing said locking seat to pivot toward said limiting rod so that said locking seat is adapted to clamp releasably the pull ropes against said limiting rod;

wherein said biasing member includes a retaining rod extending transversely between said side plates and disposed at another peripheral portion of said receiving space opposite to said limiting rod, and a pair of torsion springs, each of which is sleeved on said retaining rod and has a first end abutting against a respective one of said side plates of said hollow base and a second end, said second ends of said torsion springs being connected to one another to form a biasing portion which abuts against said locking seat for biasing said locking seat to pivot towards said limiting rod.

6. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on the opposite longitudinal sides of the slats and having upper ends secured to the shaft and lower ends mounted on the bottom rail, and plurality of suspending strings disposed below each of the slats and interconnecting the tilting cords, said operating device comprising:

a hollow base adapted to be disposed in the top housing, said hollow base including a pair of side plates which form a receiving space therebetween, and a limiting rod extending transversely between said side plates and disposed at a peripheral portion of said receiving space, said hollow base being adapted to permit extension of the second ends of the pull ropes and the shaft into said receiving space;

a locking seat mounted pivotally to said side plates and disposed in said receiving space on one side of said limiting rod such that the pull ropes are extendible between said locking seat and said limiting rod; and a biasing member mounted on said hollow base for biasing said locking seat to pivot toward said limiting rod so that said locking seat is adapted to clamp releasably the pull ropes against said limiting rod;

wherein said locking seat is formed with a teethed retaining protrusion for enhanced friction with the pull ropes, and wherein said side plates of said hollow seat are formed with aligned pivot holes, said locking seat having opposite first and second tubular extensions mounted pivotally on said side plates in said pivot holes, said locking seat further including a retaining sleeve which is sleeved securely on said first tubular extension and which is formed with said retaining protrusion.

7. The operating device according to claim 6, wherein said first tubular extension has an outer surface formed with an axially extending rib, said retaining sleeve having an inner surface formed with an axially extending groove for engaging said rib.

* * * * *